US009260836B2

(12) United States Patent
Nakata et al.

(10) Patent No.: US 9,260,836 B2
(45) Date of Patent: Feb. 16, 2016

(54) EARTHMOVING APPARATUS FOR CONSTRUCTION MACHINE

(71) Applicant: HITACHI CONSTRUCTION MACHINERY CO., LTD., Tokyo (JP)

(72) Inventors: Akira Nakata, Tsuchiura (JP); Hiroshi Tsukui, Tsuchiura (JP); Makoto Oota, Tsuchiura (JP); Yuuichi Todokoro, Tsuchiura (JP); Tomokatsu Tomiyama, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 14/350,132

(22) PCT Filed: Oct. 5, 2012

(86) PCT No.: PCT/JP2012/075943

§ 371 (c)(1),
(2) Date: Apr. 7, 2014

(87) PCT Pub. No.: WO2013/051694

PCT Pub. Date: Apr. 11, 2013

(65) Prior Publication Data

US 2014/0318818 A1 Oct. 30, 2014

(30) Foreign Application Priority Data

Oct. 7, 2011 (JP) ..... 2011-222827

(51) Int. Cl.

| | |
|---|---|
| ***E02F 3/76*** | (2006.01) |
| ***E02F 3/815*** | (2006.01) |
| ***E02F 9/22*** | (2006.01) |
| ***E02F 9/08*** | (2006.01) |

(52) U.S. Cl.

CPC ..... *E02F 3/7622* (2013.01); *E02F 3/769* (2013.01); *E02F 3/815* (2013.01); *E02F 3/8155* (2013.01); *E02F 9/0891* (2013.01); *E02F 9/2271* (2013.01)

(58) Field of Classification Search

USPC ..... 172/811, 828, 684, 788; 37/264
IPC ..... E02F 3/815,3/8152, 3/844
See application file for complete search history.

(56) References Cited

U.S. PATENT DOCUMENTS

| | | | | |
|---|---|---|---|---|
| 2,749,630 A * | 6/1956 | Nave | ..... | 172/821 |
| 3,850,252 A * | 11/1974 | Ingalls | ..... | 172/760 |
| 4,259,794 A * | 4/1981 | Rath | ..... | 37/233 |
| 7,472,499 B2 * | 1/2009 | Schmeichel | ..... | 37/232 |

FOREIGN PATENT DOCUMENTS

| | | |
|---|---|---|
| JP | 62-072357 U | 5/1987 |
| JP | 2010-138597 A | 6/2010 |
| JP | 2011-157702 A | 8/2011 |

* cited by examiner

*Primary Examiner* — Gary Hartmann
(74) *Attorney, Agent, or Firm* — Volpe and Koenig, P.C.

(57) ABSTRACT

An earthmoving apparatus includes an earthmoving blade (9) extending in the width direction of an undercarriage, a lifting unit (10) configured to move the earthmoving blade (9) up and down, and a cover unit (12) covering the lifting unit (10), wherein the earthmoving blade (9) can be moved by the lifting unit between a grounded position in which the earthmoving blade is in contact with the ground surface and a retracted position in which the earthmoving blade is held highest off the ground surface, while keeping a nearly vertical orientation with respect to the ground surface, the cover unit (12) includes a sub cover (27) extending from a location above the lifting unit (10) toward the earthmoving blade (9) and a main cover (28) slidable on the upper surface of the sub cover (27), the main cover (28) is pivotally attached to the earthmoving blade (9) in such a manner that one end portion of the main cover is nearly in contact with the top surface of the earthmoving blade, and when the earthmoving blade (9) is in the grounded position, the other end portion of the main cover overlaps with the sub cover (27).

3 Claims, 13 Drawing Sheets

EARTHMOVING APPARATUS FOR CONSTRUCTION MACHINE

TECHNICAL FIELD

The present invention relates to an earthmoving apparatus for a construction machine, and more particularly, to an earthmoving apparatus used in a construction machine to prevent entry of earth and sand to the inside of the earthmoving apparatus.

BACKGROUND ART

A construction machine of this type, for example, a wheeled hydraulic excavator, is equipped an undercarriage and an upper slewing structure swingably mounted on the undercarriage. The upper slewing structure has an operator's cab arranged on the left side of a front part thereof. Also, a boom, an arm, and a bucket are mutually pivotally attached to the upper slewing structure. Further, a fuel tank, a hydraulic oil tank, an engine and the like are mounted on the rear part of the upper slewing structure.

An earthmoving apparatus is mounted on at least one of the front and rear parts of the undercarriage to perform earthmoving work as well as to block off earth and sand during operation of the construction machine so that the earth and sand may not accumulate under the construction machine. Such earthmoving work and blocking of earth and sand are carried out by an earthmoving blade provided in the earthmoving apparatus (see Patent Document 1, for example).

CITATION LIST

Patent Literature

Patent Document 1: Unexamined Japanese Utility Model Publication No. S62-72357

SUMMARY OF INVENTION

Technical Problem

In the earthmoving apparatus disclosed in Patent Document 1, however, nothing is provided for covering an upper region behind the earthmoving blade, with the result that the machinery arranged inside the earthmoving apparatus, such as hydraulic cylinders, is exposed to outside. Thus, during work, earth and sand may fly over the earthmoving blade and collide against the machinery, possibly damaging the machinery.

The present invention was made in view of the above conventional technique, and an object thereof is to provide an earthmoving apparatus for a construction machine whereby, even if earth and sand scatter and fly to a region above an earthmoving blade, such earth and sand can be blocked off and prevented from entering the interior of the earthmoving apparatus.

Solution to Problem

To achieve the object, the present invention provides an earthmoving apparatus mounted on at least one of front and rear parts of an undercarriage of a construction machine, including: an earthmoving blade extending in a width direction of the undercarriage; a lifting unit arranged between the earthmoving blade and the undercarriage and fixed to the undercarriage, the lifting unit being configured to move the earthmoving blade up and down relative to the undercarriage; and a cover unit covering the lifting unit, wherein the earthmoving blade can be moved by the lifting unit between a grounded position in which the earthmoving blade is in contact with a ground surface and a retracted position in which the earthmoving blade is held highest off the ground surface, while keeping a nearly vertical orientation with respect to the ground surface, the cover unit includes a sub cover extending from a location above the lifting unit toward the earthmoving blade, and a main cover slidable on an upper surface of the sub cover, the main cover is pivotally attached to the earthmoving blade in such a manner that one end portion of the main cover is nearly in contact with a top surface of the earthmoving blade, and when the earthmoving blade is in the grounded position, the other end portion of the main cover overlaps with the sub cover.

Preferably, the sub cover has a downwardly curved portion at a distal end portion thereof located near the earthmoving blade.

Preferably, the main cover has a bent portion bent toward the lifting unit along a width direction of the main cover.

Preferably, the sub cover has a ridge protruding from the upper surface thereof and extending in a sliding direction of the main cover.

Advantageous Effects of Invention

According to the present invention, the main cover is pivotally attached to the earthmoving blade in such a manner that the one end portion (proximal end portion) thereof is nearly in contact with the top surface of the earthmoving blade. Thus, even if earth and sand scatter and fly to a region above the earthmoving blade during work, such earth and sand strike against the main cover and can be prevented from entering the lifting unit. Also, since the proximal end portion of the main cover is situated nearly in contact with the top surface of the earthmoving blade to minimize the gap between the earthmoving blade and the main cover, entry of earth and sand through the gap can be restrained. Further, when the earthmoving blade is in the grounded position, the main cover overlaps with the sub cover, leaving no gap therebetween, so that the effect of preventing entry of earth and sand can be enhanced. The expression "the one end portion (proximal end portion) of the main cover is nearly in contact with the top surface of the earthmoving blade" means that there may be a gap formed between the two to such an extent that the main cover is allowed to pivotally move relative to the earthmoving blade, and does not necessarily mean that the main cover perfectly contacts with the earthmoving blade. The gap between the main cover and the earthmoving blade is of a size such that almost all of earth and sand is unable to pass through the gap.

Also, the sub cover has the downwardly curved portion at its distal end portion located near the earthmoving blade, and therefore, when the main cover slides on the sub cover upward to the retracted position, the other end portion (distal end portion) of the main cover moves while following the upper surface of the sub cover. Consequently, during the movement of the main cover, the distal end portion of the main cover does not project upward away from the upper surface of the sub cover. Instead, the main cover moves along the upper surface of the sub cover and is smoothly accommodated in the space between the upper slewing structure and the undercarriage.

Further, the main cover has the bent portion bent toward the lifting unit along the width direction of the main cover, and this makes it possible to reliably prevent the distal end portion of the main cover from projecting upward more than necessary when the earthmoving blade is lifted.

Also, the ridge is formed so as to protrude from the upper surface of the sub cover and extend in the sliding direction of the main cover. The ridge serves to reduce the area of contact between the main cover and the sub cover and allows the main cover to slide smoothly. The earthmoving blade can therefore be smoothly moved up and down.

DESCRIPTION OF EMBODIMENTS

Figure 1:
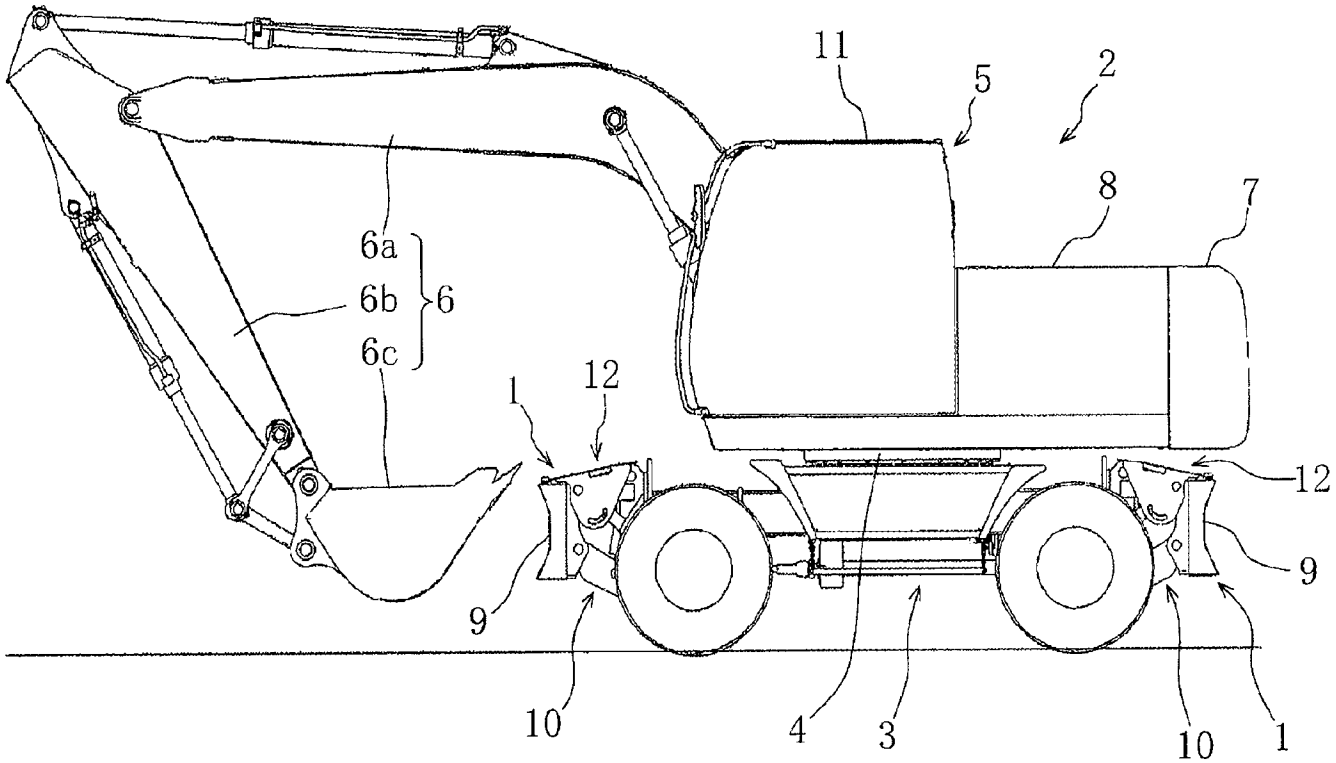
FIG. 1 is a schematic side view of a construction machine equipped with earthmoving apparatus according to the present invention.

A wheeled excavator 2 illustrated in FIG. 1 will be explained below as an example of a construction machine equipped with earthmoving apparatus 1 according to the present invention. The earthmoving apparatus 1 is mounted on at least one of front and rear parts of an undercarriage 3 of the wheeled excavator 2 (FIG. 1 illustrates an exemplary case where the earthmoving apparatus is mounted to both of the front and rear parts of the undercarriage).

An upper slewing structure 5 is mounted on the undercarriage 3 with a slewing ring 4 therebetween. Thus, the upper slewing structure 5 can swing relative to the undercarriage 3. Work equipment 6 including a boom 6*a*, an arm 6*b* and a bucket 6*c* is attached to the upper slewing structure 5. An operator's compartment (cab) 11 is arranged on the left side of the front part of the upper slewing structure 5. Also, a counterweight 7 is arranged at the rear of the upper slewing structure 5 to counterbalance the work equipment 6 and thereby keep balance of the excavator as a whole.

An engine, a hydraulic pump and various tanks such as a fuel tank and a hydraulic oil tank (none of which are shown) are mounted on the rear part of the upper slewing structure 5 and covered with a cover member 8.

Figure 2:
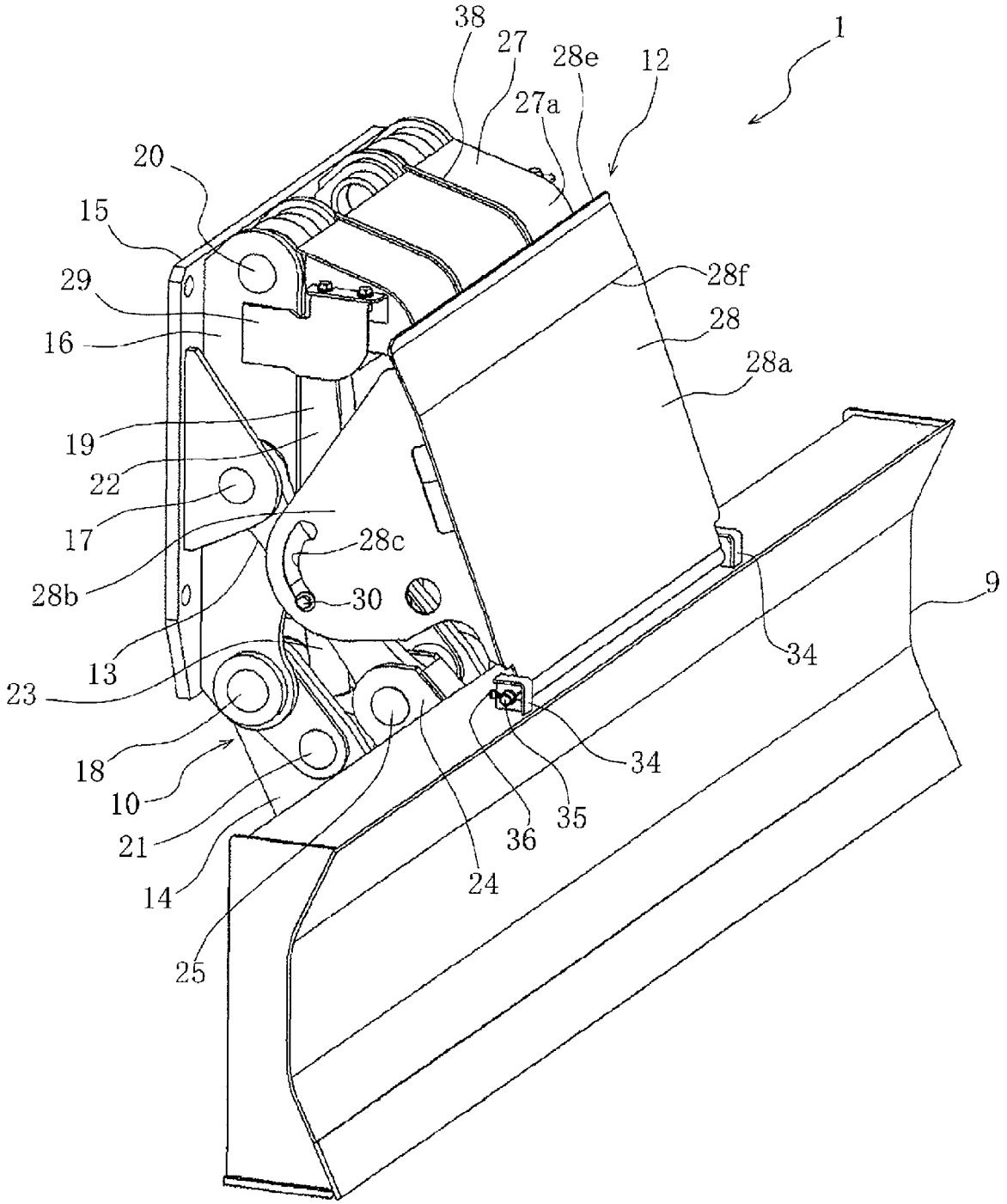
FIG. 2 is a schematic perspective view of the earthmoving apparatus.

As illustrated in FIG. 2, each earthmoving apparatus 1 includes an earthmoving blade 9, a lifting unit 10, and a cover unit 12. The earthmoving blade 9 extends in a width direction of the undercarriage 3. That is, the earthmoving blade 9 has a horizontally elongated shape. The lifting unit 10 is arranged between the earthmoving blade 9 and the undercarriage 3 and is fixed to the undercarriage 3. The earthmoving blade 9 can be moved up and down by the lifting unit 10 relative to the undercarriage 3. Specifically, the lifting unit 10 is provided with a parallel link mechanism including an upper linkage 13 and a lower linkage 14. The lifting unit 10 also includes a mounting plate 15 fixed to the undercarriage 3. The upper and lower linkages 13 and 14 are pivotally supported at one end by a pair of, right and left first walls 16 projecting from the mounting plate 15, so as to be able to turn about respective pivots 17 and 18 serving as fulcrums.

Further, the lifting unit 10 includes hydraulic cylinders 19. Each hydraulic cylinder 19 is connected to the upper end of the corresponding first wall 16 and the lower linkage 14 by pivots 20 and 21, respectively. Specifically, a cylinder tube 22 constituting a proximal end portion of the hydraulic cylinder 19 is coupled to the first wall 16, and a piston rod 23 of the hydraulic cylinder 19 is coupled to the lower linkage 14.

Accordingly, as the hydraulic cylinders 19 retract, the lower linkage 14 is pulled up while turning about the pivot 18. Second walls 24 project from the back surface of the earthmoving blade 9. The upper and lower linkages 13 and 14 are connected at the other end to the second walls 24 by pivots 25 and 26, respectively. When the lower linkage 14 is pulled upward by the hydraulic cylinders 19 as stated above, the upper linkage 13 also rises while turning about the pivot 17 serving as a fulcrum, so that the earthmoving blade 9 lifts.

Figure 7:
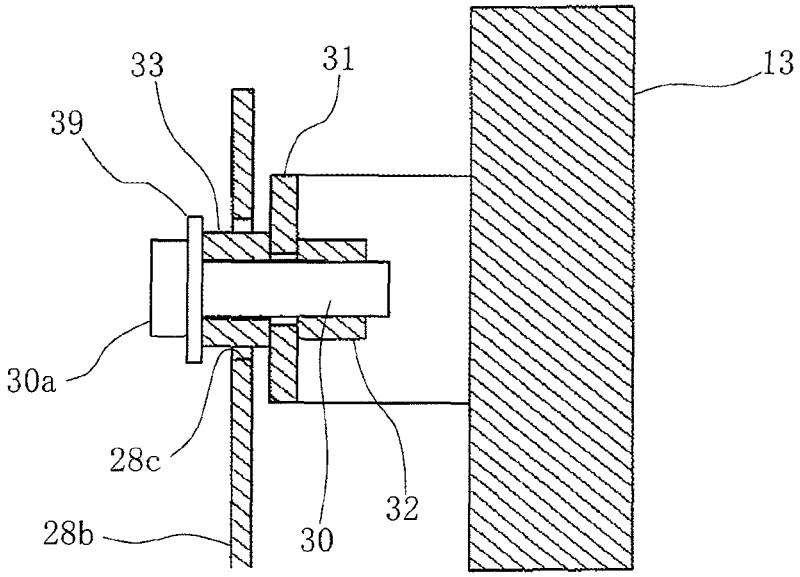
FIG. 7 schematically illustrates a structure for coupling a side cover body and an upper linkage.

The lifting unit 10 is covered with a cover unit 12. The cover unit 12 includes a sub cover 27 extending from a location above the lifting unit 10 toward the earthmoving blade 9, and a main cover 28 slidable on the upper surface of the sub cover 27. Specifically, the sub cover 27 is fixed to the first walls 16 by respective mounting members 29. The main cover 28 is constituted by a cover body 28*a* configured to overlap with the sub cover 27, and side cover bodies 28*b* projecting from respective opposite side edges of the cover body 28*a*. A curved elongate hole 28*c* is formed through each side cover body 28*b*. A bolt 30 fixed to the upper linkage 13 is inserted through the elongate hole 28*c*. More specifically, as shown in FIG. 7, a sheet screw 31 is secured to the upper linkage 13, and the bolt 30 is inserted through the elongate hole 28*c* and a hole in the sheet screw 31. The bolt 30 is fixed in position by a backing nut 32. A substantially cylindrical boss 33 is disposed in the elongate hole 28*c*, and the bolt 30 penetrates through the boss 33. A washer 39 is interposed between the boss 33 and a head 30*a* of the bolt 30. By fixing the side cover bodies 28*b* of the main cover 28 to the upper linkage 13 with use of the elongate holes 28*c* and the bolts 30, it is possible to prevent the main cover 28 from moving away from the sub cover 27 and tilting toward the front of the earthmoving blade 9. Also, displacement of the main cover 28 in the width direction can be restricted. The elongate holes 28*c* are curved in accordance with the movement locus of the upper linkage 13 so that the main cover 28 may move along the upper surface of the sub cover 27.

Figure 6:
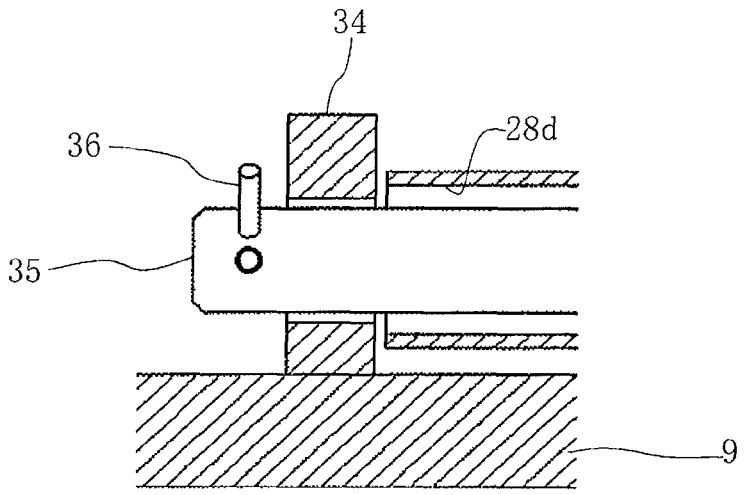
FIG. 6 schematically illustrates a structure for coupling the earthmoving blade and a cover body.

The cover body 28*a* is pivotally attached at one end (lower end) to the earthmoving blade 9 in such a manner that the lower end of the cover body 28*a* is nearly in contact with the top surface of the earthmoving blade 9. Specifically, as shown in FIG. 6, the lower end of the cover body 28*a* is bent into a substantially cylindrical shape to form a shaft hole 28*d*. A pair of, right and left shaft supports 34 project from the top surface of the earthmoving blade 9. A shaft 35 is inserted through the shift hole 28*d* and respective holes in the shaft supports 34. The opposite ends of the shaft 35 are fitted with retaining pins 36, respectively. For the retaining pins 36, β pins may be used, for example. By pivotally attaching the main cover 28 to the earthmoving blade 9 in this manner, it is possible to prevent a substantial gap from being created between the main cover 28 and the earthmoving blade 9. Thanks to the configuration described above, the earthmoving blade 9 lifts in conjunction with operation of the hydraulic cylinders 19, and as the upper linkage 13 turns upward, the main cover 28 moves upward along the sub cover 27 and at the same time the bolts 30 slide within the respective elongate holes 38*c*.

The earthmoving blade 9 can be moved by the lifting unit 10 between a grounded position and a retracted position while keeping a nearly vertical orientation with respect to the ground surface. Specifically, the grounded position denotes a state in which the lower surface of the earthmoving blade 9 is in contact with the ground surface, and the retracted position denotes a state in which the earthmoving blade 9 is held highest off the ground surface by the lifting unit 10. FIG. 1 illustrates the earthmoving blade 9 in the retracted position, and FIG. 2 illustrates the earthmoving blade 9 in the grounded position.

Figure 3:
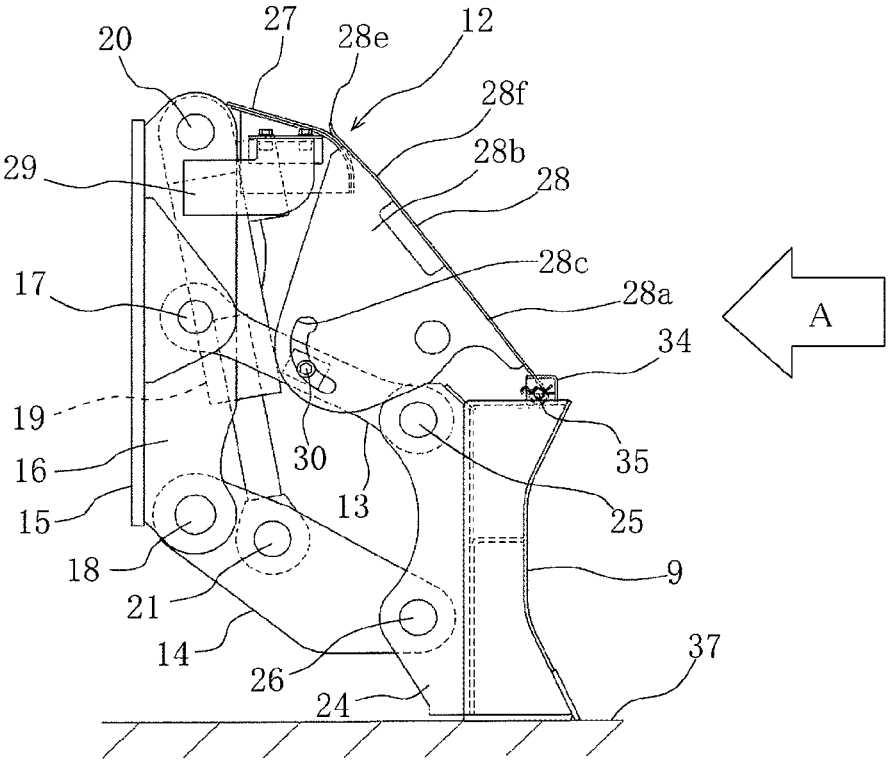
FIG. 3 is a schematic side view illustrating a state in which an earthmoving blade is located in a grounded position.

When the earthmoving blade 9 is located in the grounded position as shown in FIG. 3, the lower surface of the earthmoving blade 9 is in contact with the ground surface 37. Also, the other end (upper end) of the main cover 28 constituting the cover unit 12 overlaps with the sub cover 27. During operation of the construction machine with the earthmoving blade located in the grounded position, earth and sand fly toward the construction machine from a direction indicated by an arrow A. Since the earthmoving blade 9 and the cover unit 12 are located closely to each other to block off the earth and sand flying in such a direction, the earthmoving apparatus 1 can prevent the earth and sand from colliding against the lifting unit 10 (hydraulic cylinders 19 constituting the lifting unit, valves and the like for feeding hydraulic oil under pressure to the hydraulic cylinders 19). Specifically, the main cover 28 is pivotally attached to the earthmoving blade 9 in such a manner that the lower end (proximal end) thereof is nearly in contact with the top surface of the earthmoving blade 9. Thus, even if earth and sand scatter and fly to a region above the earthmoving blade during work, such earth and sand strike against the main cover 28 and can be prevented from entering the lifting unit 10. Also, since the lower end (proximal end) of the main cover 28 is situated nearly in contact with the top surface of the earthmoving blade 9 to minimize the gap between the earthmoving blade 9 and the main cover 28, entry of earth and sand through the gap can be restrained. Further, when the earthmoving blade 9 is in the grounded position, the main cover 28 overlaps with the sub cover 27, leaving no gap therebetween, so that the effect of preventing entry of earth and sand can be enhanced. In addition, the side cover bodies 28*b* serve to prevent earth and sand from entering from sides.

Figure 5:
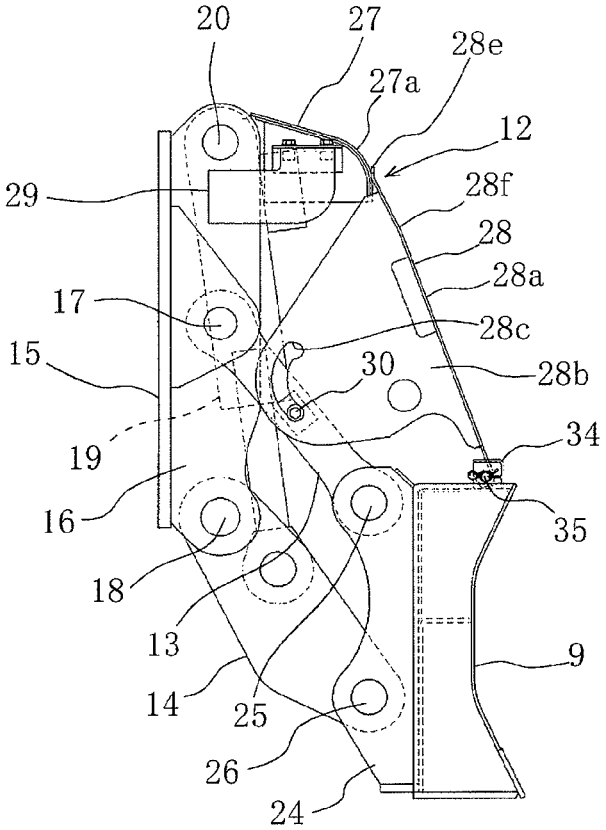
FIG. 5 is a schematic side view illustrating a state in which the earthmoving blade is located in a lowest position.

Construction work is performed under various ground surface conditions, and accordingly, the relative height of the grounded position of the earthmoving blade 9 shown in FIG. 3 varies depending on the site of work. FIG. 5 illustrates a lowest position of the earthmoving blade 9. Even in the lowest position, the lifting unit 10 is covered closely with the earthmoving blade 9 and the cover unit 12 with respect to the direction of the arrow A. The sub cover 27 has a downwardly curved portion 27*a* at a distal end portion thereof located near the earthmoving blade 9.

Figure 4:
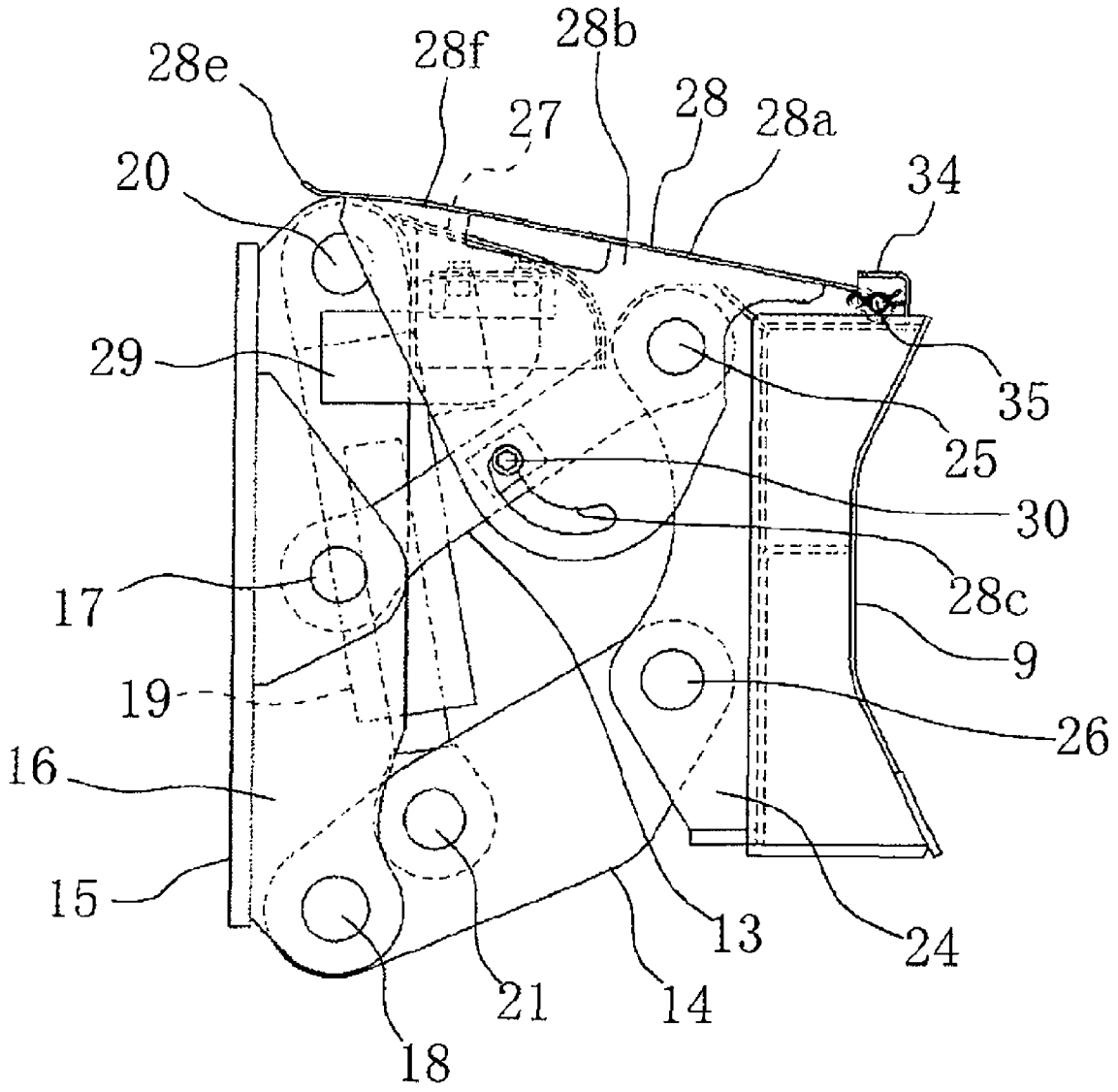
FIG. 4 is a schematic side view illustrating a state in which the earthmoving blade is located in a retracted position.

As the earthmoving blade 9 is lifted from the lowest position shown in FIG. 5 to the retracted position (highest position) shown in FIG. 4, the main cover 28 overlapping with the sub cover 27 moves while sliding on the sub cover 27. That is, the other end (distal end) 28*e* of the main cover 28 moves while following the upper surface of the sub cover 27. During the movement of the main cover 28, therefore, the distal end of the main cover 28 does not project upward away from the upper surface of the sub cover 27. Instead, the main cover 28 moves along the upper surface of the sub cover 27 and is smoothly accommodated in the space between the upper slewing structure 5 and the undercarriage 3.

To enhance the effect of preventing collision of the main cover 28 against the upper slewing structure 5, the main cover 28 may further include a bent portion 28*f*. The bent portion 28*f* is formed by bending the main cover 28 along its width direction toward the lifting unit 10. By forming the bent portion 28*f* in this manner, it is possible to restrict upward projection of the distal end 28*e* of the main cover 28 when the main cover 28 slides on the sub cover 27 due to lifting of the earthmoving blade 9. Consequently, the main cover 28 is allowed to move along the upper surface of the sub cover 27 and smoothly accommodated in the space between the upper slewing structure 5 and the undercarriage 3.

Further, as is clear from FIG. 2, the sub cover 27 has ridges 38 protruding from the upper surface thereof and extending in the sliding direction of the main cover 28. The number of the ridges 38 to be formed may be changed as needed (in FIG. 2, two ridges 38 are formed). The ridges 38 serve to reduce the area of contact between the main cover 28 and the sub cover 27, thus enabling the main cover 28 to slide smoothly. The earthmoving blade 9 can therefore be smoothly moved up and down. In consideration of slidability, the ridges 38 are made of, for example, metal.

In the retracted position, the main cover 28 extends past the sub cover 27 to such an extent that the distal end portion 28*e* thereof partly covers the first walls 16. Thus, also in the retracted position, earth and sand can be prevented from flying into the lifting unit 10 (e.g. while the construction machine is running). The distal end 28*e* of the main cover 28 may be extended past the sub cover 27 up to a position where the first walls 16 are covered in their entirety with the main cover 28.

The earthmoving apparatus may alternatively be configured as described below, in order to improve the slidability between the main cover 28 and the sub cover 27 and thereby reduce noise accompanying the sliding movement and solve the problem of paint separation. In the following description of embodiments illustrated in FIGS. 8 to 15, only the differences between the individual embodiments and the foregoing embodiment will be explained since in other respects the embodiments are configured in the same manner as the foregoing embodiment.

Figure 8:
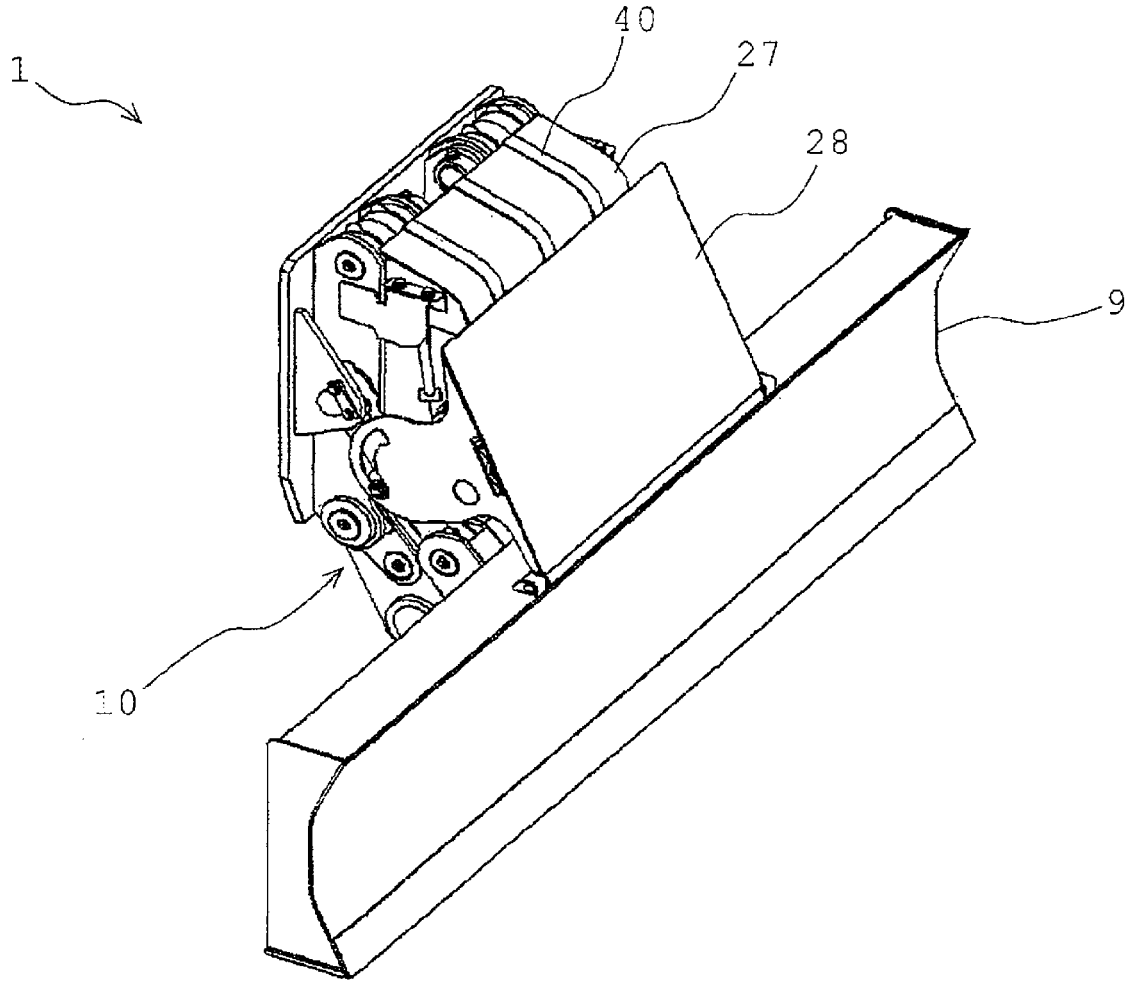
FIG. 8 schematically illustrates another earthmoving apparatus according to the present invention.
Figure 9:
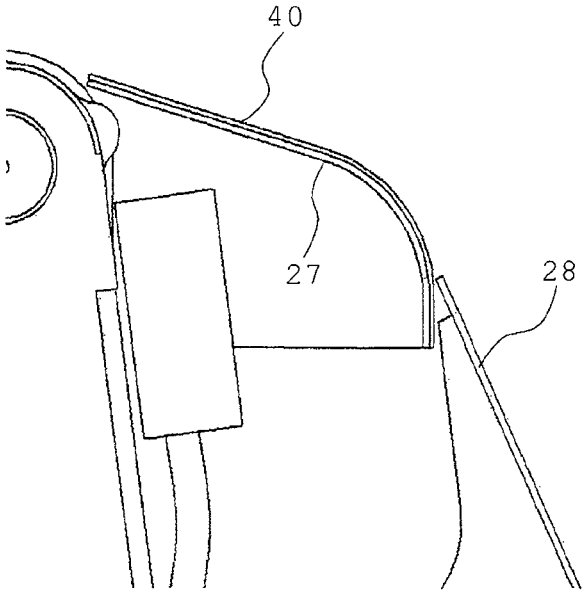
FIG. 9 is a schematic side view showing a main cover and a sub cover used in the earthmoving apparatus of FIG. 8.

As shown in FIGS. 8 and 9, rubber plates 40 may be affixed to the upper surface of the sub cover 27 so as to extend in the sliding direction of the main cover 28. The number of the rubber plates 40 to be provided may be changed as needed (in FIG. 8, three rubber plates 40 are provided). Because of the presence of the rubber plates 40, the main cover 28 made of metal slides while contacting with the rubber plates 40, whereby noise accompanying the sliding movement can be reduced and also the problem of paint separation from the main cover 28 can be solved. In place of the rubber plates 40, plates made of resin may be used.

Figure 10:
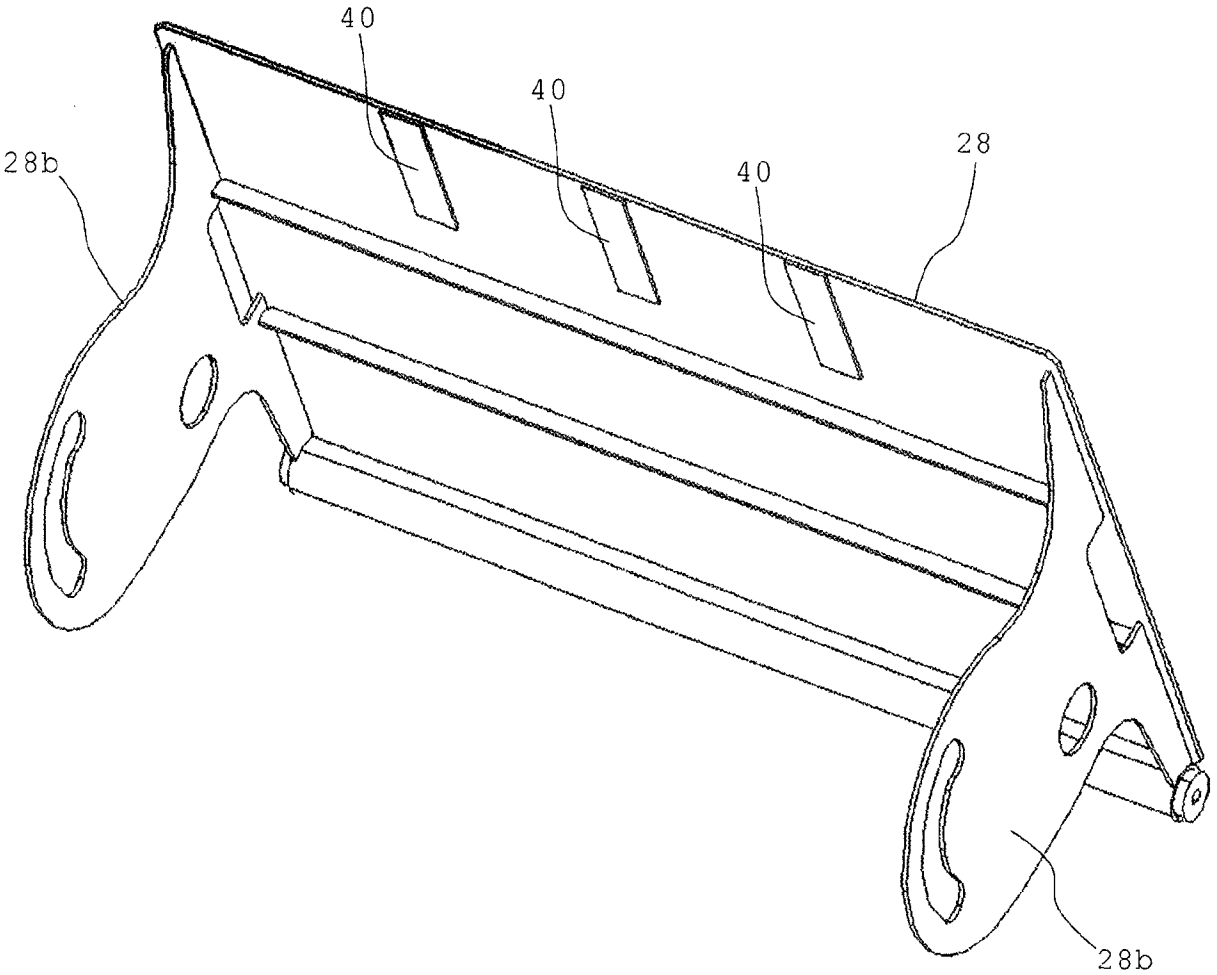
FIG. 10 schematically illustrates a main cover used in another earthmoving apparatus according to the present invention.

Alternatively, the rubber plates 40 may be affixed to the inner surface of the main cover 28, as shown in FIG. 10. In this case, the rubber plates 40 shown in FIGS. 8 and 9 are not provided on the upper surface of the sub cover 27. When the main cover 28 slides, the rubber plates 40 contact with the sub cover 27. Thus, also with this configuration, noise accompanying the sliding movement can be reduced and the problem of paint separation from the main cover 28 can be solved.

Figure 11:
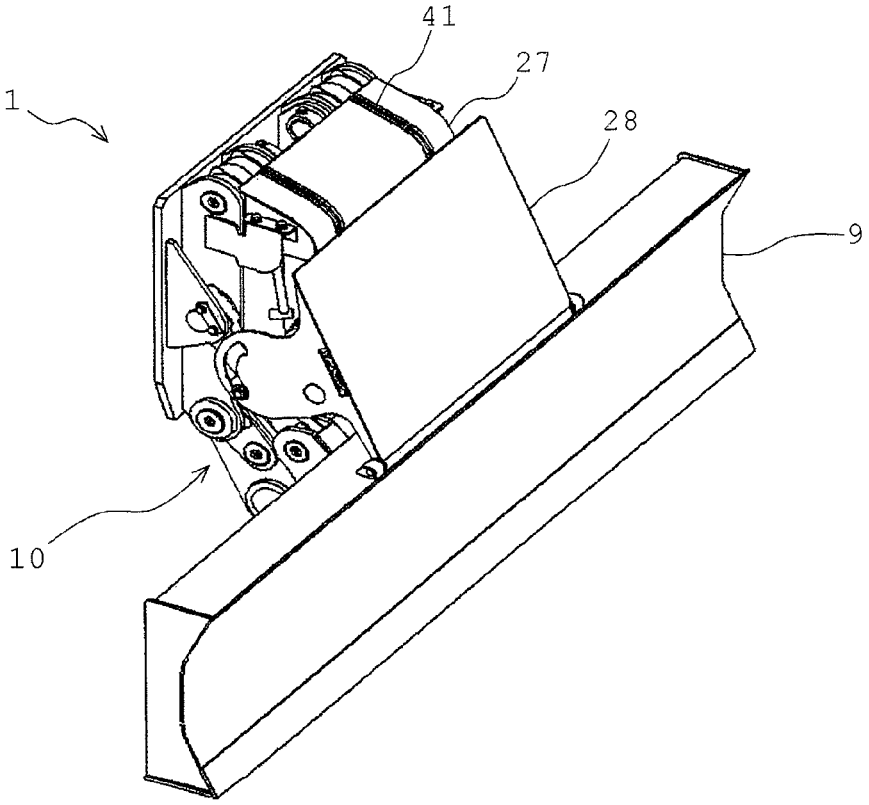
FIG. 11 schematically illustrates still another earthmoving apparatus according to the present invention.
Figure 12:
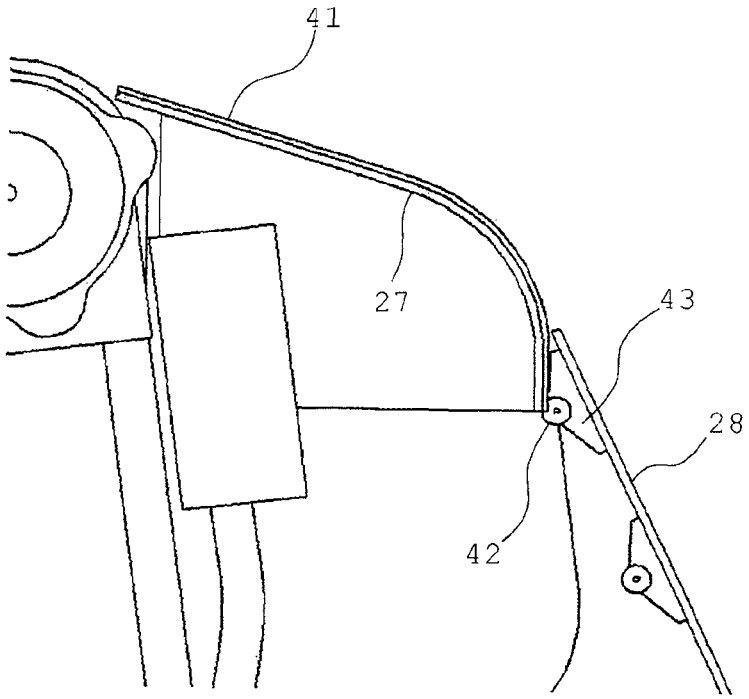
FIG. 12 is a schematic side view exemplifying a main cover and a sub cover used in the earthmoving apparatus of FIG. 11.
Figure 13:
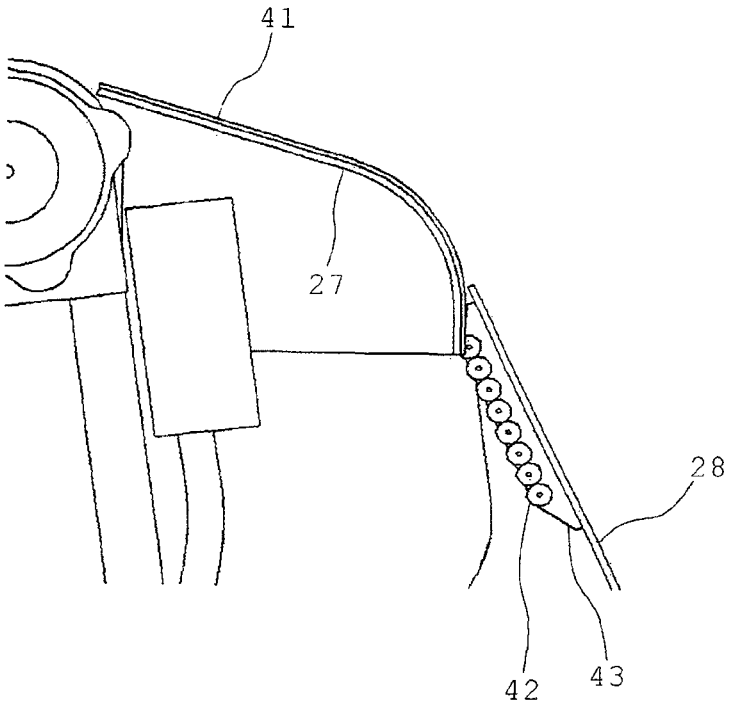
FIG. 13 is a schematic side view exemplifying a main cover and a sub cover used in the earthmoving apparatus of FIG. 11.

On the other hand, as shown in FIGS. 11 and 12, the sub cover 27 may be provided with rails 41 attached to the upper surface thereof and extending in the sliding direction of the main cover 28, and the main cover 28 may be provided with rollers 42 configured to roll along the respective rails 41. Each roller 42 is supported on the main cover 28 by a support 43. In the example illustrated in FIG. 12, a single roller 42 is supported by a single support 43, but as shown in FIG. 13, a plurality of rollers (in FIG. 13, eight rollers) may be supported by a single support 43. The use of the rails 41 and the rollers 42 serves to improve the slidability of the main cover 28, reduce noise accompanying the sliding movement, and solve the problem of paint separation from the main cover 28. The rails 41 and the rollers 42 may be made of metal, but where rubber or resin is used to form either of the rails and the rollers, the noise reduction effect can be further enhanced.

Figure 14:
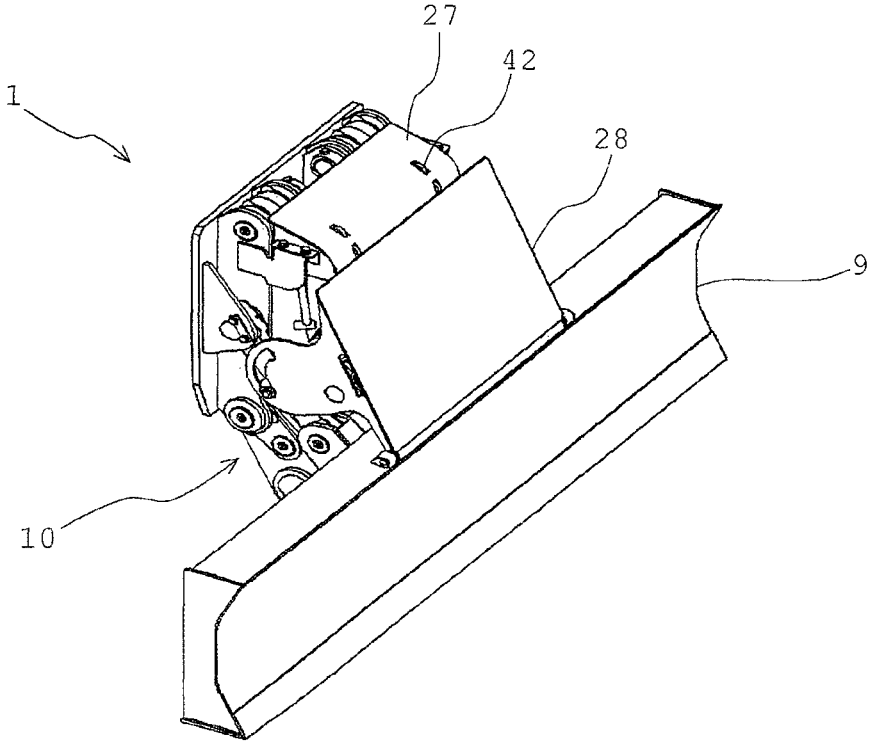
FIG. 14 schematically illustrates yet another earthmoving apparatus according to the present invention.
Figure 15:
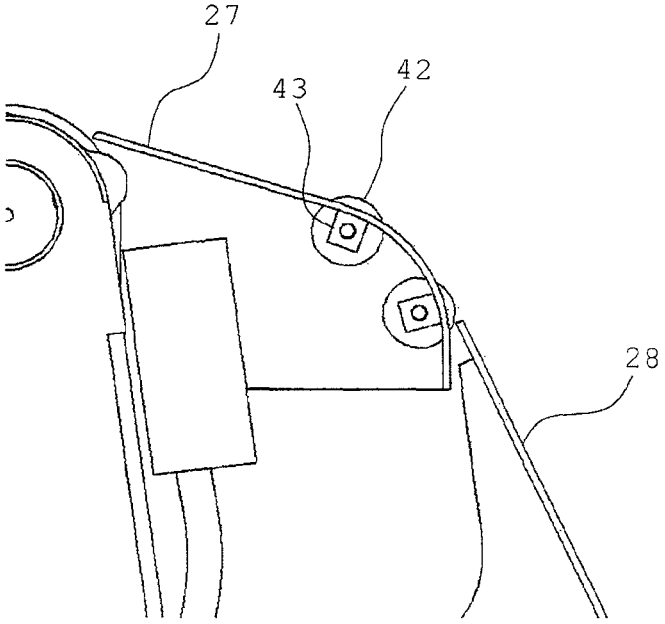
FIG. 15 is a schematic side view showing a main cover and a sub cover used in the earthmoving apparatus of FIG. 14.

As illustrated in FIGS. 14 and 15, moreover, the sub cover 27 may be provided with rollers 42. In this case, supports 43 may be attached to the surface of the sub cover 27 opposite the sliding surface to support the respective rollers 42, and cuts may be formed in the sub cover 27 such that the rollers 42 are partly exposed, or project outside through the respective cuts. Thus, as the main cover 28 slides, the rollers 42 rotate with their exposed portions disposed in rolling contact with the main cover 28. Also with this configuration, the slidability of the main cover 28 can be improved, noise accompanying the sliding movement can be reduced, and the problem of paint separation from the main cover 28 can be solved. The main cover 28 may be provided with rails 41, if necessary.

REFERENCE SIGNS LIST

1: earthmoving apparatus
2: wheeled excavator
3: undercarriage
4: slewing ring
5: upper slewing structure
6: work equipment
6*a*: boom
6*b*: arm
6*c*: bucket
7: counterweight
8: cover member
9: earthmoving blade
10: lifting unit
11: operator's compartment
12: cover unit
13: upper linkage
14: lower linkage
15: mounting plate
16: first wall
17: pivot
18: pivot
19: hydraulic cylinder
20: pivot
21: pivot
22: cylinder tube
23: piston rod
24: second wall
25: pivot
26: pivot
27: sub cover
27*a*: curved portion
28: main cover
28*a*: cover body
28*b*: side cover body
28*c*: elongate hole
28*d*: shaft hole
29: mounting member
30: bolt
30*a*: bolt head
31: sheet screw
32: backing nut
33: boss
34: shaft support
35: shaft
36: retaining pin
37: ground surface
38: ridge
39: washer
40: rubber plate
41: rail
42: roller
43: support

The invention claimed is:

1. An earthmoving apparatus mounted on at least one of front and rear parts of an undercarriage of a construction machine, comprising:

an earthmoving blade extending in a width direction of the undercarriage;

a lifting unit arranged between the earthmoving blade and the undercarriage and fixed to the undercarriage, the lifting unit being configured to move the earthmoving blade up and down relative to the undercarriage; and a cover unit covering the lifting unit, wherein the earthmoving blade can be moved by the lifting unit between a grounded position in which the earthmoving blade is in contact with a ground surface and a retracted position in which the earthmoving blade is held highest off the ground surface, while keeping a nearly vertical orientation with respect to the ground surface, the cover unit includes a sub cover extending from a location above the lifting unit toward the earthmoving blade, and a main cover slidable on an upper surface of the sub cover, the main cover is pivotally attached to the earthmoving blade in such a manner that one end portion of the main cover is nearly in contact with a top surface of the earthmoving blade, and the other end portion of the main cover overlaps with the sub cover when the earthmoving blade is in the grounded position, the main cover includes a cover body overlapping with the sub cover, and side cover bodies projecting from respective opposite side edges of the cover body, the side cover bodies each have a curved elongate hole formed therethrough, the lifting unit has protrusions inserted through the respective elongate holes, the sub cover has a ridge protruding from the upper surface thereof and extending in a sliding direction of the main cover, and the main cover moves with sliding along the upper surface of the sub cover, so that the distal end of the main cover does not project upward away from the upper surface of the sub cover, when the earthmoving blade moves from the grounded position to the retracted position.

2. The earthmoving apparatus according to claim 1, wherein the sub cover has a downwardly curved portion at a distal end portion thereof located near the earthmoving blade.

3. The earthmoving apparatus according to claim 2, wherein the main cover has a bent portion bent toward the lifting unit along a width direction of the main cover.

* * * * *